US005689399A

United States Patent [19]

Tsao et al.

[11] Patent Number: 5,689,399

[45] Date of Patent: Nov. 18, 1997

[54] VERSATILE SWITCHING MODULE

[75] Inventors: Sai Hoi Tsao, Ottawa, Canada; Forest Shih-Sen Chien, Sanchung, Taiwan

[73] Assignee: Industrial Technology Research Institute, Hsinchu, Taiwan

[21] Appl. No.: 215,695

[22] Filed: Mar. 22, 1994

[51] Int. Cl.[6] ..... H01H 47/22

[52] U.S. Cl. ..... 361/191

[58] Field of Search ..... 307/112, 113, 307/116, 125, 139; 361/191

[56] References Cited

U.S. PATENT DOCUMENTS 4,918,566 4/1990 Brodsky et al. ..... 361/191

*Primary Examiner*—Fritz Fleming

*Attorney, Agent, or Firm*—Bacon & Thomas

[57] ABSTRACT

A versatile switching module to control the switching operation of multiple relay switches and to monitor the status of each relay includes a driving card and multiple relay cards, each relay card in turn including a number of relays, with each relay representing a testing channel made up of three testing terminals. In one embodiment, one driver card may be used to control four relay cards, each relay card having sixteen relays and each relay having four single-pole double-throw switches.

6 Claims, 7 Drawing Sheets

VERSATILE SWITCHING MODULE

FIELD OF THE INVENTION

The present invention relates to a versatile switching module, and especially to a versatile switching module applicable to the control of multi-channel selector switch. By modulating the switching unit this invention may be applied to a variety of testings, such as voltage testing, resistance testing and capacitance testing. This invention also provides a protection function against the plural setting of the switches wherein two levels of protection, say the "protection under relay card level" and the "protection under system level" may be selectively applied.

Background of the Invention

The switching system is a useful testing tool and may be used in many applications, including in research laboratories and in industry. In general, switching systems are useful in the testing of voltage, current, resistance, capacitance, signals of low frequency and other testings. In each application, special conditions may be required in the switching system. For example, in the testing of a plurality of voltage sources, only one channel may be selected. Selecting more than one channel may cause damage to the voltage sources. In the testing of resistance, the internal testing circuit should be isolated so to avoid the leakage current. In the testing of capacitance, the electro-magnetic isolation of the internal testing circuit is required to avoid unnecessary parallel capacitances to exist. As a result, in the manufacture of each testing tool, special arrangements must be applied to each switching system; resulting in a waste in the manufacture costs.

There is thus a need in the industry to have a versatile switching module which may be applied to a variety of testing functions.

The purpose of this invention is to provide a versatile switching module which may be employed in the manufacture of a variety of testing tools.

Another purpose of this invention is to provide a modulated switching device which may provide a variety of testing functions.

SUMMARY OF THE INVENTION

According to this invention, a versatile switching module is provided. The versatile switching module of this invention comprises a driver card and a plurality of relay cards, equipped with a number of relays wherein the driver card controls the SET/RESET operation of the relays on the relay cards and each relay on the relay cards represents a testing channel with 3 testing terminals. In a preferred embodiment of this invention, one driver card controls 4 relay cards and their relays, each relay card has 16 relays and each relay has 4 single-pole, double-throw switches. The versatile switching module of this invention provides the function of controlling the switching operation of any and all of the relays and is able to monitor the status of each relay.

The versatile switching module is so versatile that it may be applied to a variety of applications. This includes the testing of voltage, resistance and capacitance, with necessary arrangements to the relay cards. Besides, a protection and status circuit is provided in this invention so that unwanted plural setting of the switches may be avoided.

These and other objects and advantages of this invention will be apparent from the following description of preferred embodiments thereof as illustrated in the accompanying drawings.

DETAILED DESCRIPTION OF THE PREFERRED EMBODIMENT

Switching Module

The versatile switching module of this invention may be divided into two major parts: the driver card and the relay cards. In the preferred embodiment of this invention, four relay cards are adopted. The driver card serves to select and to activate one or more of the relay cards. Each relay card is equipped with a plurality of relays for which a SET/RESET operation is controlled by the driver card. An external device, such as a personal computer, may be connected with the driver card to control the operation of the latter, and thus the operation of any of the relays. A flat cable connects the driver card and any of the relay card.

Driver Card

Figure 1:
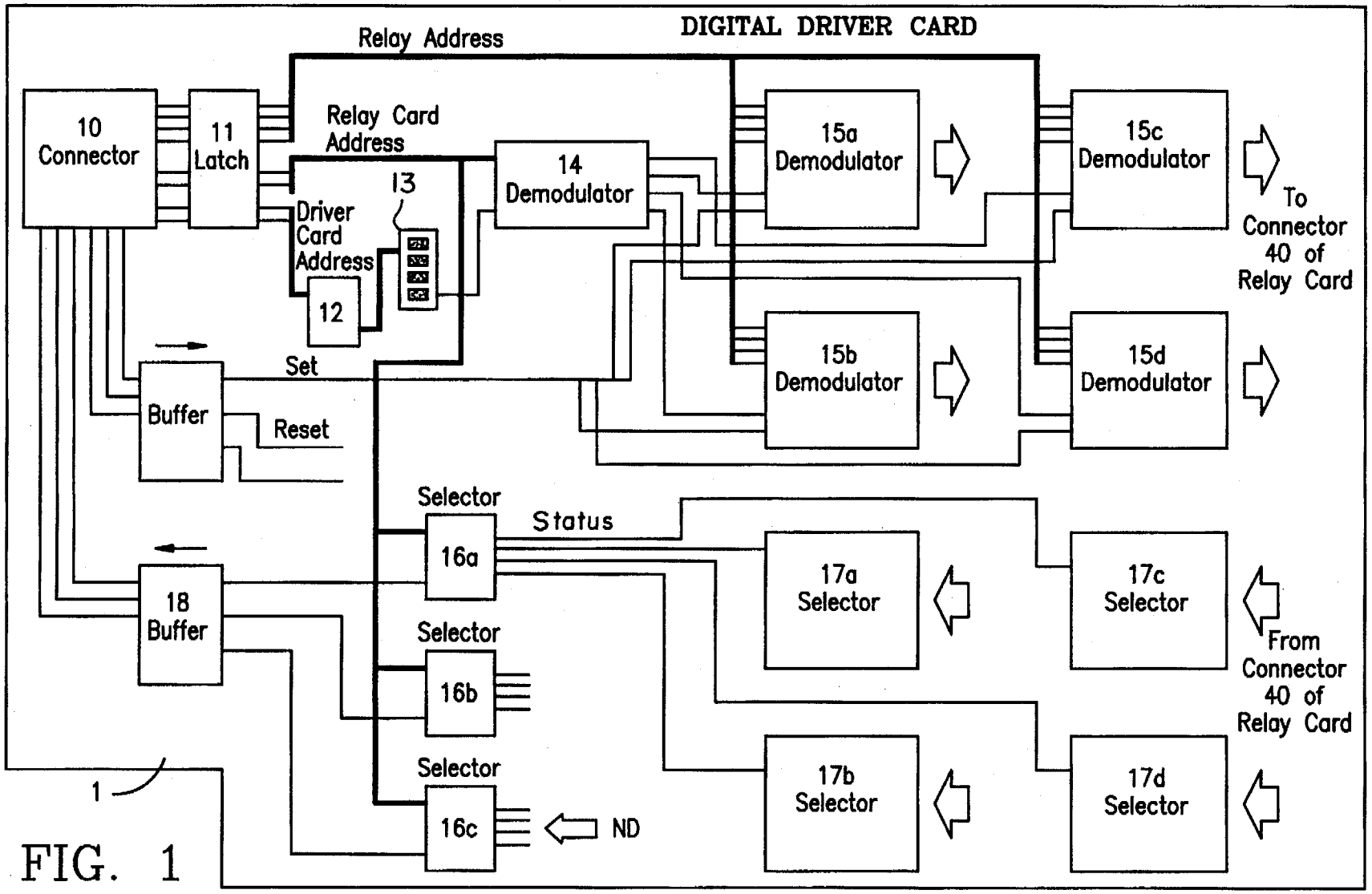
FIG. 1 shows a block diagram of a digital driver card applicable to the versatile switching module of this invention.

FIG. 1 shows a block diagram of a digital driver card 1 of the versatile switching module of this invention. As shown in the figure, the digital driver card 1 includes: a connector 10 enabling the driver card 1 to communicate with an external device, such as a personal computer (not shown), a latch 11 to generate address signals according to the input signals from the connector 10, a decoder 12 to decode the address signals from the latch 11 and to generate control signals, a dip switch 13 to compare the control signals from the decoder 12 to control the ON/OFF operation of the demutiplexers 14, a demultiplexer 14 to receive address signals from the latch 11 and to generate control signals to control the ON/OFF operation of the demultiplexers 15*a*–15*d* and the selectors 17*a*–17*d*, a demultiplexer array 15*a*–15*d* to receive the address signals from the latch 11 and to generate control signals to control the ON/OFF operation of the relays 41 of the relay cards 4, selector arrays 17*a*–17*d* to receive feed-back signals from the relays 41 of the relay cards 4 and to transmit the signals to selector 16*a*, and selector 16*a* to receive signals from selector array 17*a*–17*d* and to transmit the signals to the connector 10 via a buffer 18. The connector 10 is a 40 pin connector which connects the driver card 1 and the external device (not shown) and the demultiplexers 15*a*–15*d* and the selector array 17*a*–17*d* use four 50 pin connectors which connect the driver card 1 with the four relay cards 4 respectively. Connector 40 generates RDY and NP signals to connector 10 via selectors 16*b* and 16*c* and a buffer 18.

The latch 11 has eight address input lines. Among the input lines, two are connected to a decoder 12 and represent the addresses of the selected driver card 1. This makes it possible for a switching system to have four switching modules, as in the illustrated embodiment. These lines cause the decoder 12 to generate a four-bit signal which may compare with the selected position of the dip switch 13 to enable four driver cards 1 or switching modules in one switching system to have 256 switching channels.

Two other input lines of the latch 11 represent the address of the relay cards and are connected to the demultiplexer 14 so that the demultiplexer 14 may generate control signals to control the ON/OFF operation of the demultiplexers 15*a*, 15*b*, 15*c* and 15*d* and of the selectors 17*a*, 17*b*, 17*c* and 17*d*. The relay card address data may be provided to the selectors 16*a*, 16*b* and 16*c* so that the selectors 16*a*, 16*b* and 16*c* may provide feed-back signals to the connector 10 via the buffer 18. Among the selectors 16*a*–16*c*, selector 16*a* provides the "STATUS" signal of the selected relay 41 on the relay card which it receives from selectors 17*a*, 17*b*, 17*c* and 17*d*, and selectors 16*b* and 16*c* provide the "READY" and the "NO PROTECTION" signals, both of the selected relay card 4. The selectors 17*a*, 17*b*, 17*c* and 17*d* provide the "STATUS" of the selected relay of the selected relay card.

The remaining four address lines of the latch 11 provide the addresses of the relays 41, of any one of the relay cards 4, and are connected to the demultiplexers 15*a*, 15*b*, 15*c* and 15*d* so that these demultiplexers may generate control signals to control the ON/OFF operation of the selected relays 41 of a selected relay card 4.

Relay Cards

Figure 2:
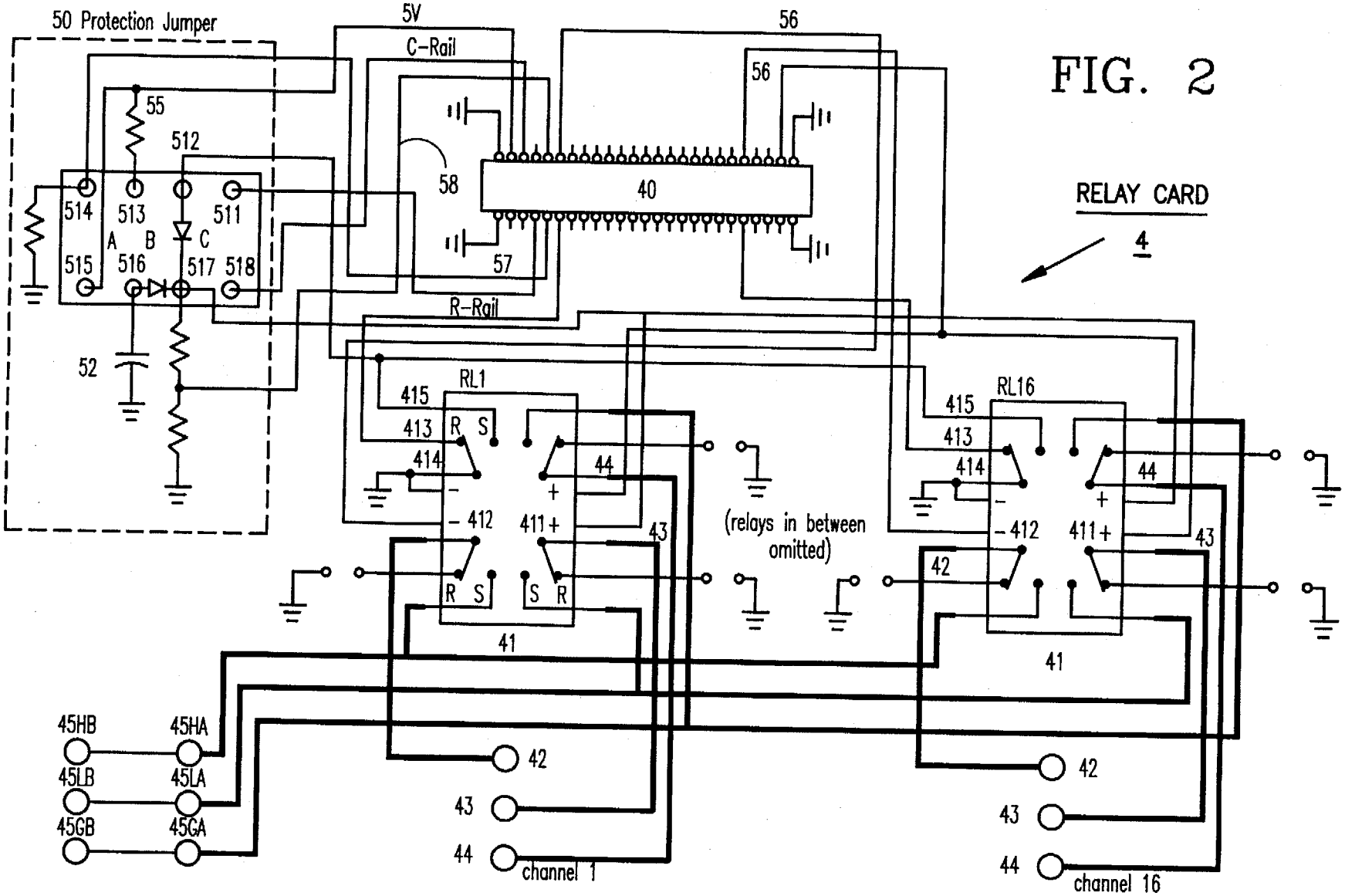
FIG. 2 shows a schematic diagram of a relay card applicable to the versatile switching module of this invention.

FIG. 2 shows a schematic diagram of a relay card used in the versatile switching module of this invention. In the preferred embodiment of this invention, each relay card 4 has sixteen relays 41. In the figure, only the first and the last (the 16th) relays 41 are shown. As shown in the figure, each relay 41 comprises four single-pole, double-throw switches, functioning as one channel. Three of the switches are employed for signal switching; their C terminals are connected to terminals 42, 43 and 44 and their S terminals are connected to terminals 45H, 45L and 45G. In this embodiment, each of the testing terminals 45G, 45L and 45H further comprises two terminal points, 45GA and 45GB, 45LA and 45LB and 45HA and 45HB.

Switching Operation

In the application of this versatile switching module, signals input to the connector 10 include: the address of the selected driver card 1, the address of the selected relay card 4, and the address of the selected relay 41. Other signals may be commands, SET and RESET signals. The address of the driver card 1 enters the decoder 12 via the latch 11 and is compared with the position of the dip switch 13. If the address is correct, the demultiplexer 14 is turned ON accordingly. The address of the selected relay card 4 enters the demultiplexer 14 via the latch 11 and the demultiplexer 14 generates a control signal to turn ON one of the demultiplexers 15*a*–15*d* is corresponding to the selected relay card 4. The address of the selected relay 41 enters the demultiplexers 15*a*–15*d* via the latch 11 and the demultiplexer 15 which is turned ON generates a control signal which turns ON the selected relay 41 of the selected relay card 4 via the connector 40. Thus the SET terminal point 415 of the selected relay 41 of the selected relay card 4 is short. The status (SET) of this relay 41 is then fed-back to the connector 17 via the connector 40. This status signal is then sent to the connector 16*a* of the driver card 1 and to the connector 10 via the buffer memory 18.

The above is the description of the set switching operation. The reset switching operation is similar to the set switching operation.

After the first relay is reset, the second selected relay may be set/reset according to the process as described above.

Protection and Status Circuit

A "protection and status circuit" 50 is provided in the relay card 4 to provide the function of protection and the function of monitoring the status of the relays. The protection and status circuit 50 is connected to the selectors 17*a*, 17*b*, 17*c* and 17*d* through the connector 40 and provides the related signals to the connector array 16*a*–16*c*.

Figure 3:
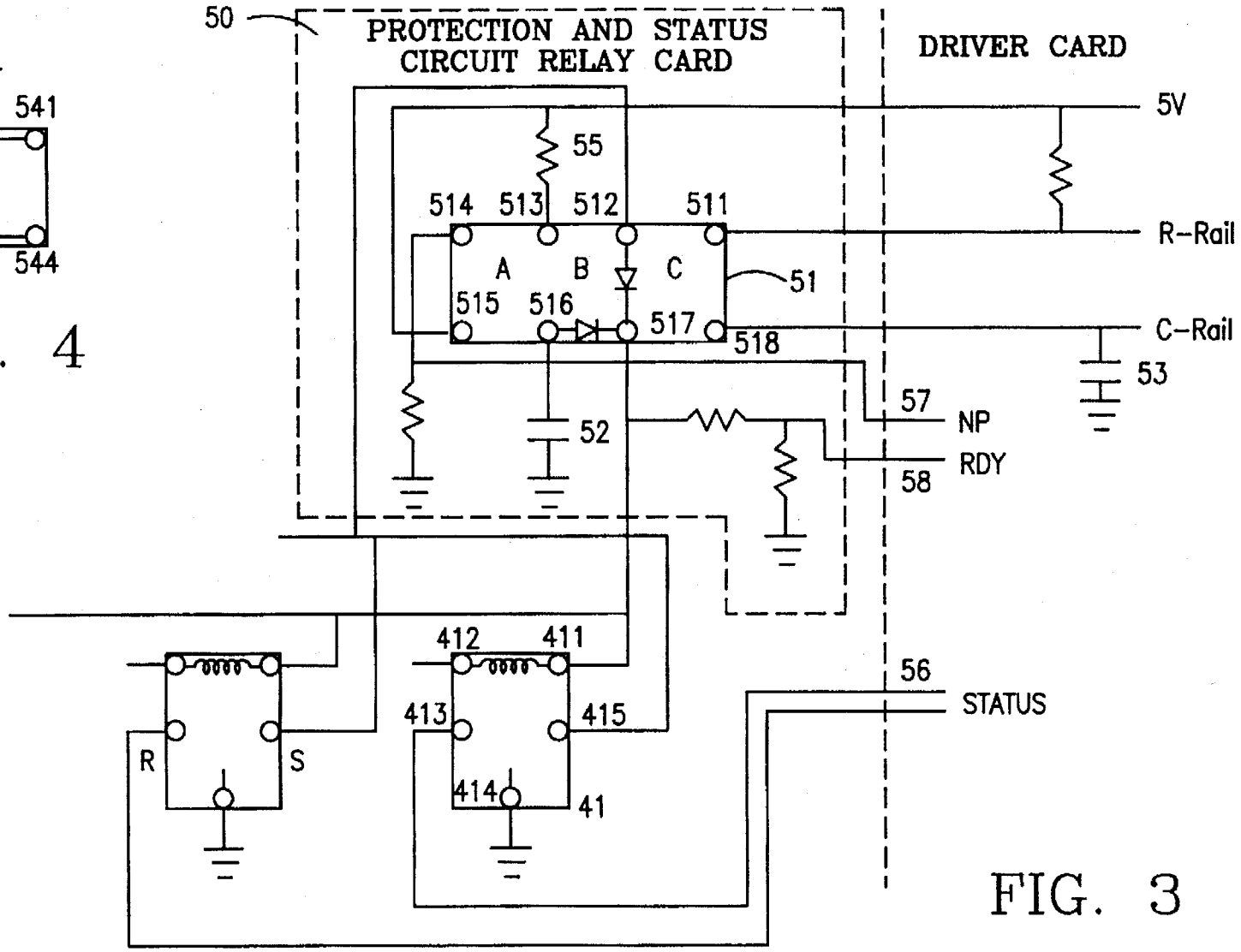
FIG. 3 shows a circuit diagram of the "protection and status circuit" used in the relay cards of the versatile switching module of this invention.

The protection and status circuit 50 is one of the major features of this invention. The protection and status circuit 50 provides three levels of protection to the system which are: "no protection" level model, "protection under relay card" level and "protection under system" level. FIG. 3 shows the circuit diagram of the protection and status circuit 50 used in this embodiment. In the figure, 51 represents a jumper and comprises eight terminal points 511–518 wherein terminal point 511 is connected to an R-rail and 516 and 518 are connected to capacitors 52 and 53 respectively. The capacitors 52 and 53 are so designed that the energy stored therein may not exceed that sufficient to activate one relay 41.

41 represents a relay positioned on the relay card 4 of the preferred versatile switching module. In the relay, the terminal points 411 and 412 are connecting points of the coil, 413 is RESET, 414 is COMMON and 415 is SET (See also FIG. 2.).

Figure 4:
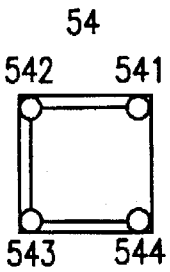
FIG. 4 shows a circuit diagram of a jumper block used in connection with the "protection and status circuit" of FIG. 3.

The protection and status circuit 50 further comprises a jumper block 54 which has four terminal points. The circuit diagram of the jumper block 54 is shown in FIG. 4. The terminal points 541 and 542, 542 and 543 and 543 and 544 of the jumper block 54 are connected respectively.

The versatile switching module of this invention employs the protection and status circuit 50 to provide three levels of protection to the system, i.e., the "no protection" level, the "protection under relay card" level and the "protection under system" level. The details of the three models will be described as follows:

A. NO PROTECTION

When the jumper block 54 is positioned at the A position of FIG. 4, the 5V voltage comes into the terminal point 513 of the protection and status circuit 50 (equivalent to 541 of the jumper block 54, and so on) through resistance 55. The voltage then passes by terminal points 514 (542), 515 (543) and 516 (544) and enters into the capacitor 52. The energy of the capacitor 52 enters into connector 411 of the relay 41 through terminal point 517 and when a relay 41 is selected, its terminal point 412 will be ground by the demultiplexer 15 so that the coil will be enacted and the relay is turned ON At this time point, the "STATUS" line 56 of relay 41 is LOW, meaning the relay 41 is ON, while the "NO PROTECTION" line 57 is HIGH, meaning that the system is under "no protection" status, and the "READY" line 58 is HIGH, meaning other relays are ready to set. If at this time a driving signal is output from the driver card 1 to activate other relays, the other selected relay or relays may be set ON.

B. PROTECTION UNDER RELAY CARD

When the jumper block 54 is positioned at the B position of FIG. 3, the 5V voltage comes into the terminal point 513 of the protection and status circuit 50 (equivalent to 542 of the jumper block 54, and so on) through resistor 55. The voltage then passes by terminal point 516 (543) and enters into the capacitor 52. The energy of the capacitor 52 enters into terminal point 411 of the relay 41 through terminal point 517 (544) and activates the coil, turning on the relay. As a result, the SET 415 and COMMON 414 are electrically connected and the terminal point 512 is ground. Because terminal points 512 and 513 are connected, the 5V voltage, and thus the capacitor 52, are grounded so that no energy may be applied to activate the other relays 41. At this point, the "STATUS" line 56 of relay 41 is LOW, meaning the relay 41 is ON, while the "NO PROTECTION" line 57 is LOW, meaning that the system is under "protection" status, and the "READY" line 58 is LOW meaning other relays may not be set. If at this time a driving signal is output from the driver card 1 to activate other relays, the other selected relay or relays may not be set ON.

C. PROTECTION UNDER SYSTEM

When the jumper block 54 is positioned at the C position of FIG. 3, the 5V voltage comes into the terminal point 511 of the protection and status circuit 50 (equivalent to 541 of the jumper block 54, and so on) through resistor 55. The voltage then passes by terminal points 512 (542), 517 (543) and 518 (544) and enters into the capacitor 53. The energy of the capacitor 53 enters into terminal point 411 of the relay 41 through terminal points 518 (544) and 517 (543) and energizes the coil, turning on the relay. As a result, the SET 415 and COMMON 414 of the relay 41 are shorted and the terminal point 512, and thus the 5V voltage, are grounded so that no energy may be furnished by the capacitor 52, nor by the capacitor 53, to enact other relays 41 or other relay cards 4. At this time point, the "STATUS" line 56 of relay 41 is LOW, meaning the relay 41 is ON, while the "NO PROTECTION" line 57 is LOW, meaning the system is under "protection" status, and the "READY" line 58 is LOW meaning no other relays are ready to set. If at this time point a driving signal is output from the driver card 1 to enact other relays or other relay cards, the other selected relay(s) or relay card(s) may not be set ON.

By employing the above-mentioned protection and status circuit 50, accompanying with the jumper block 54, the following information may be provided by the system:

(I) The status of the functioning relay or relays.

(II) Whether the system is under the "protection" status (i.e., when the jumper block 54 is positioned at the B or C position), or the "no protection" status (i.e., when the jumper block 54 is positioned at the A position).

(III) Whether any other relay is ready to set at a certain time point.

What is important is that the system may control the number of relays ready to set at a time point according to the above-mentioned three protection levels.

Figure 8:
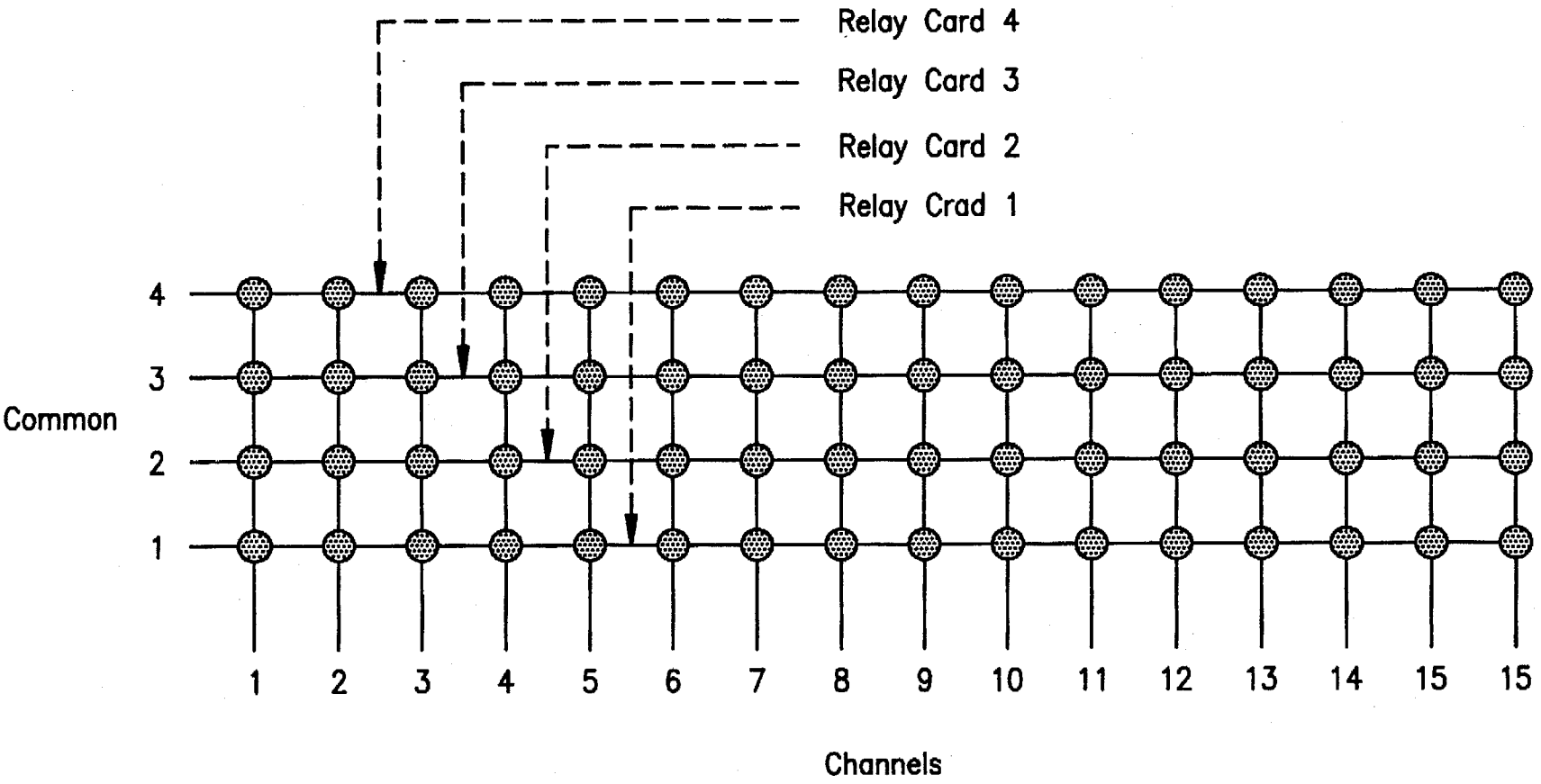
FIG. 8 shows a 16 * 4 matrix scanner employing the versatile switching module of this invention.

As this invention modulates the switching system, the switching module of this invention may be used in the manufacture of a variety of testing tools. The combination of the four relay cards is so versatile that four relay cards may be connected in line to form a 64 channel matrix switch system (FIG. 8). The relay cards may be arranged as a 4 row * 16 channel matrix switch system Other combinations may be arranged and decided by the user according to the application. As a result, the versatile switching module of this invention may be used as a switching device of standard cells, a 1 row * 32 channel, 4-terminal resistance matrix scanner, high resistance or capacitance scanner, capacitor permutator and so on.

Applications

Figure 5:
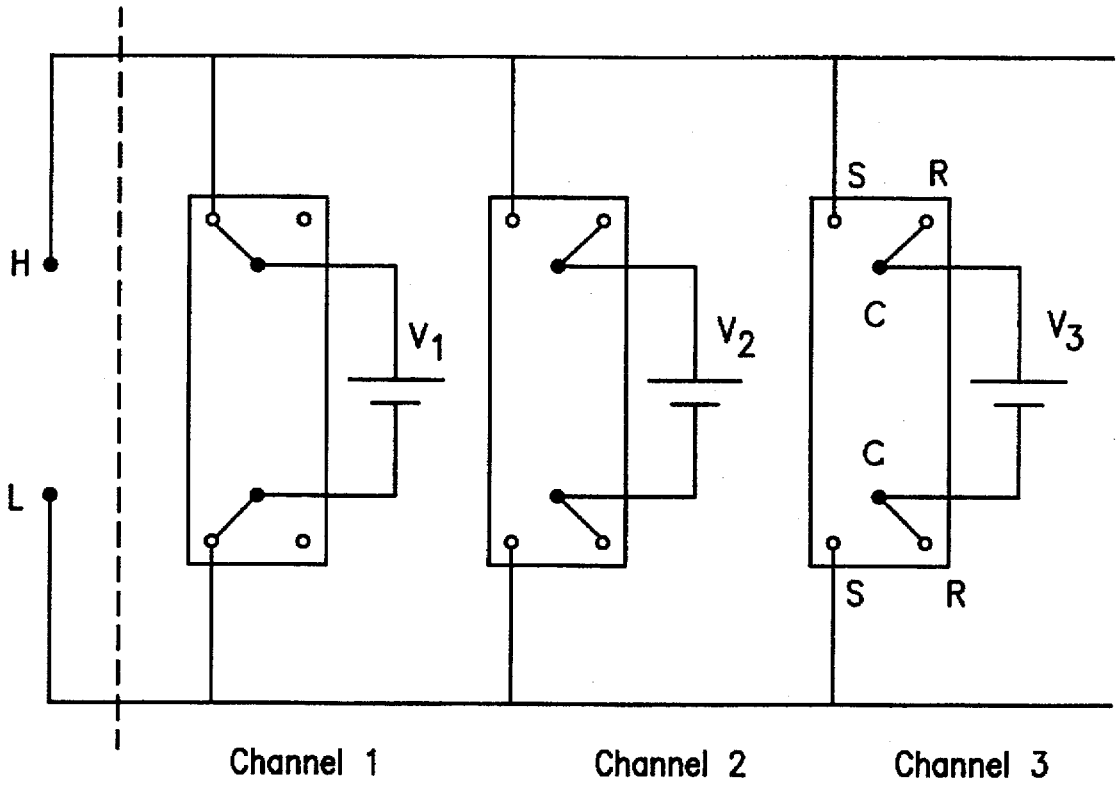
FIG. 5 shows a circuit diagram of three channels of one relay card functioning as a voltage source scanner employing the versatile switching module of this invention.

The applications of the versatile switching module of this invention may be illustrated as follows:

FIG. 5 illustrates the circuit diagram of three channels of one relay card functioning as a voltage source scanner employing the versatile switching module of this invention. In this application, the switching device has 64 channels. In the figure, channel 1 is set and others are not. The voltage V1 is tested and the voltage of V1 may be obtained from the terminal points H and L. The 64 channels may selected sequentially, under the control of the switching module of this invention.

Figure 6:
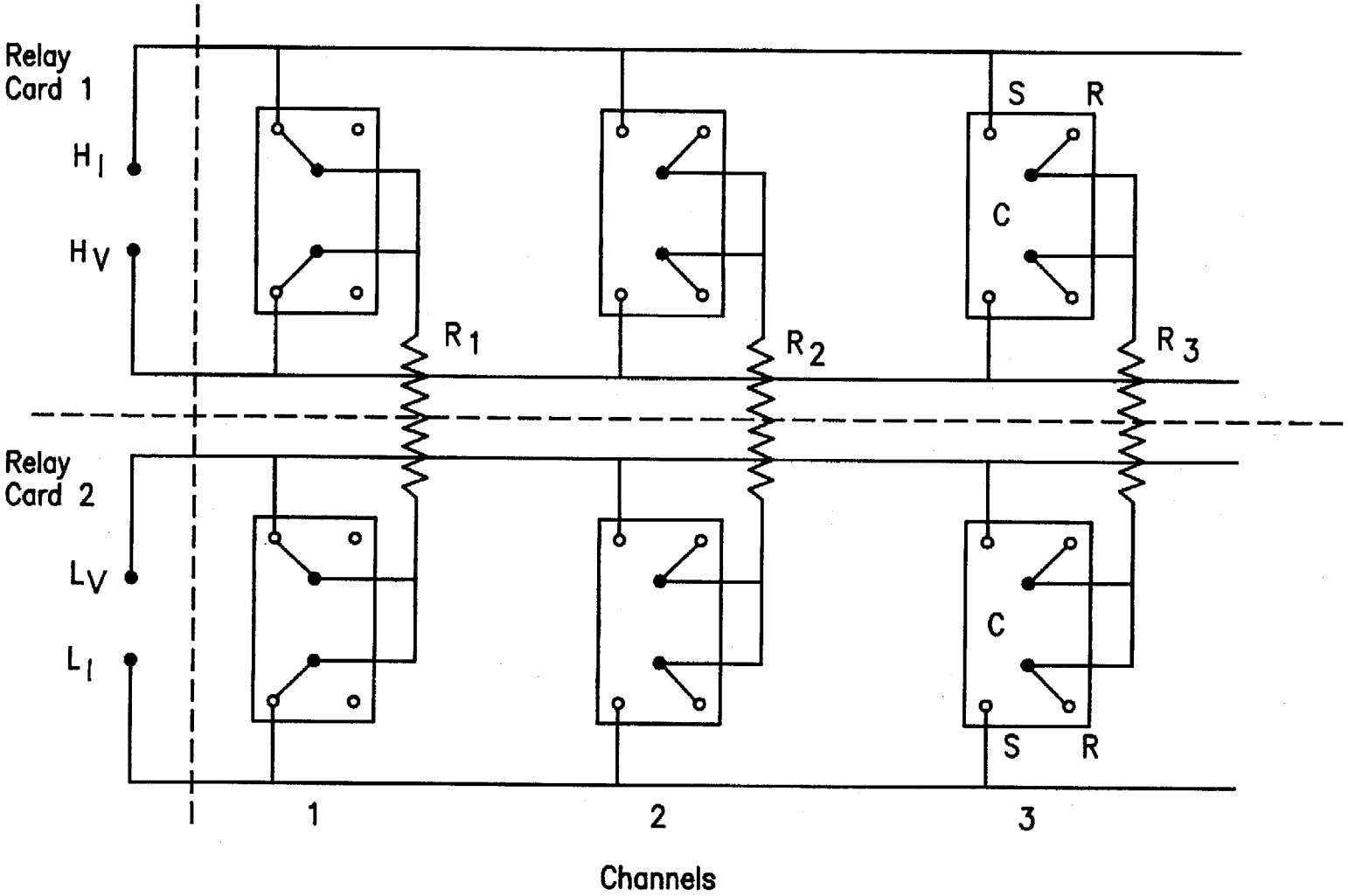
FIG. 6 shows a circuit diagram of three channels of a four-terminal resistor scanner employing two relay cards of the versatile switching module of this invention.

FIG. 6 illustrates the circuit diagram of three channels of a four-terminal resistor scanner employing two relays of two different relay cards of the versatile switching module of this invention as one channel As shown in the figure, each pair of two relays with the same address in two different relay cards functions as testing terminals of the resistance. The pairs of relays are caused to be adjacent to each other by overlapping one relay card on another. This makes the switching module to have 32 testing channels. Because the two relays of different relay cards are isolated by the air between the relay cards, additional resistance will not occur between terminals Hi and Li so that the measurement of the resistance may be correct. As shown in the figure, channel 1 is selected and set ON while others are not. The resistance of the test channel may be obtained from terminals Hi, Hv, Li and Lv.

Figure 7:
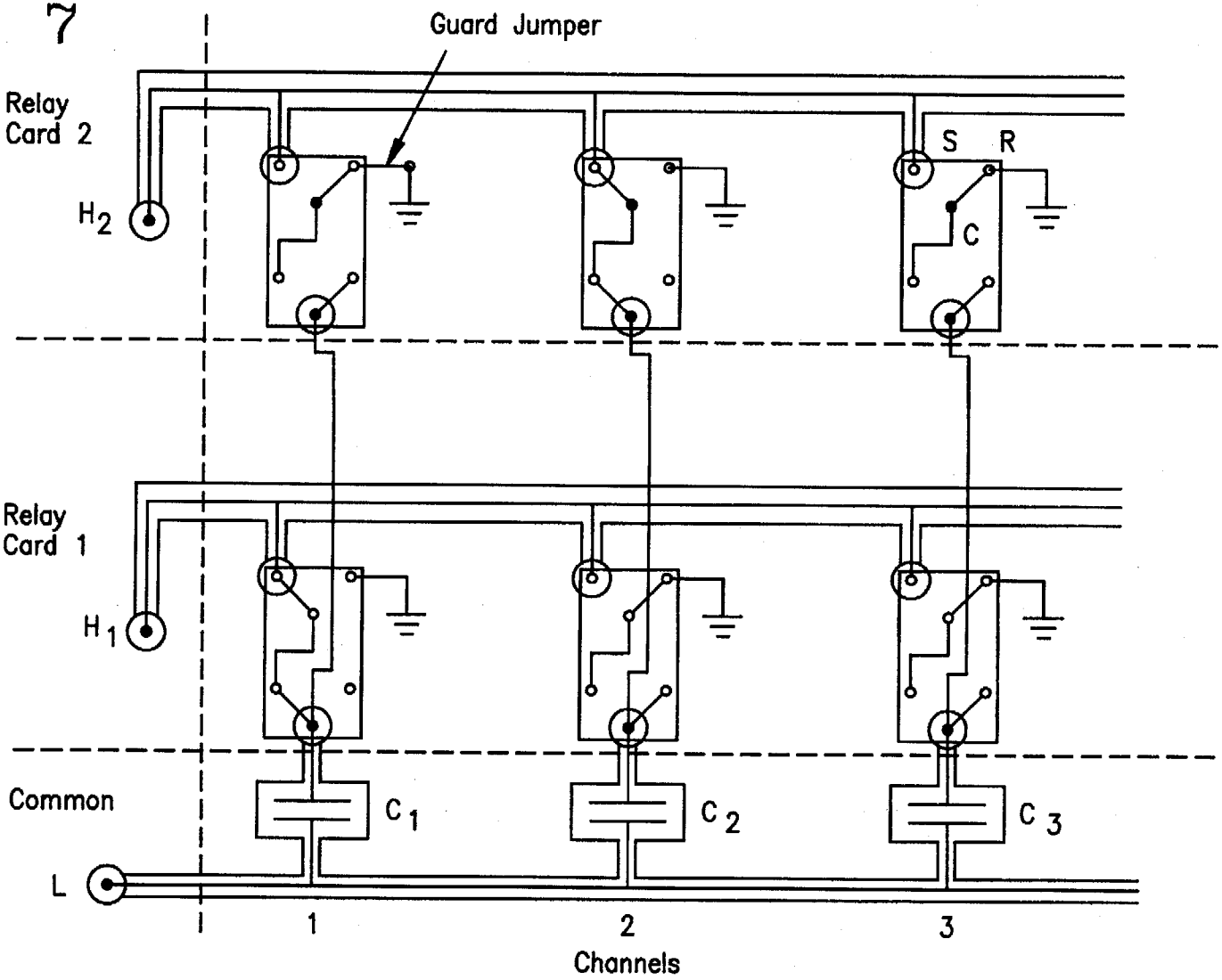
FIG. 7 shows a circuit diagram of three channels of a two-port capacitor permutator employing two relay cards of the versatile switching module of this invention.

FIG. 7 illustrates the circuit diagram of three channels of a two-port capacitor permutator employing two relays of two different relay cards of the versatile switching module of this invention as one channel. As shown in the figure, each pair of two relays with the same address in two different relay cards functions as one testing terminal of the capacitor. The pairs of relays are caused to be adjacent to each other by overlapping one relay card on another. This makes the switching module to have 32 testing channels. In this application, all wires are guarded with protection lines and are isolated with each other. Jumpers are applied to the circuits so that each relay card is guarded from other relay cards. In the figure, channel 1 of the relay card 1 and channel 2 of the relay card 2 are set ON. The capacity of capacitor 1, C1, is compared with that of capacitor 2, C2. The capacitance may be obtained from terminal points H1 and H2 and may be compared. At this present time, channel 1 of relay card 2 and channel 2 of relay card 1, and other channels are not set. The jumpers in channel 1 of relay card 2 and in channel 2 of relay card 1 form guarding wire to ensure that no additional capacitor occurs between capacitor C1 and terminal point H2 and between capacitor C2 and terminal point H1. As a result, capacitors on different relay cards may be guarded while it is under testing.

This invention provides a switching module which is applicable to a variety of testing purposes. Other applications of this invention may be understood by those skilled in the art according to the above description.

As the invention has been shown and described with reference to preferred embodiments thereof, those skilled in the art will recognize that the above and other changes may be made therein without departing from the spirit and scope of the invention.

We claim:

1. A switching module to control a switching operation of a plurality of relays in a plurality of relay cards, comprising:

a driving card to control the switching operation of a plurality of relays positioned in a plurality of relay cards comprising an interface arranged to accept at least address data input from an external device, a latch arranged to latch said input address data comprising at least address of one relay and address of one relay card, a first selector arranged to activate at least one of the relay cards and a second selector arranged to activate at least one of the relays of the relay cards, both according to the input address data of said latch;

a plurality of relay cards connected with and arranged to be activated by said first selector, each comprising a plurality of relays connected with and being able to be enacted by said second selector, wherein all relays are parallel connected with one another and each relay is connected to at least one testing terminal;

wherein each of said relays comprises at least one relay switch and at least one status signal generator.

2. The switching module according to claim 1 further comprising a protection and status circuit arranged to provide "no protection" or "protection" function to all or one selected relay card and to provide status signals representing at least one of the above-said protection functions; wherein said protection and status circuit is connected to said first selector of said driving card to control the function of said first selector.

3. The switching module according to claim 2 wherein said protection and status circuit comprises a protection circuit arranged to avoid at least one relay card or at least one relay of the relay cards to be activated, a jumper device to be connected with said protection circuit to determine the relay or relay card not to be activated, a capacitor connected with said protection circuit to store energy to activate one relay card and a capacitor connected with said protection circuit to store energy to activate all relay cards, wherein the energy store in each of the said capacitors may not exceed that sufficient to activate one relay of the relay card.

4. The switching module according to claim 1, comprising four relay cards, wherein two relay cards are arranged in the same plane and are overlapped by the other two relay cards, wherein relays on the overlapping relay cards are adjacent to relays with the same address on the overlapped relay cards, and wherein measurement is operated by picking up signals from relays with the same address on the overlapping and the overlapped relay cards.

5. The switching module according to claim 1, comprising four relay cards, wherein two relay cards are arranged on the same planar and are overlapped by the other two relay cards, wherein relays on the overlapping relay cards are adjacent to relays with the same address on the overlapped relay cards, wherein all wires are guarded with protection lines and wherein jumpers are applied to the circuits such that the poles of the non-enacted relay form protection lines to isolate the overlapping relay cards from the overlapped relay cards.

6. The switching module according to claim 1 wherein each relay of said relay cards further comprises three testing terminals.

* * * * *